US005430420A

United States Patent [19]

Maier

[11] Patent Number: 5,430,420

[45] Date of Patent: Jul. 4, 1995

[54] CONTACT ARRANGEMENT FOR A CIRCUIT BREAKER USING MAGNETIC ATTRACTION FOR HIGH CURRENT TRIP

[75] Inventor: Alfred E. Maier, Chippewa, Pa.

[73] Assignee: Eaton Corporation, Cleveland, Ohio

[21] Appl. No.: 185,629

[22] Filed: Jan. 24, 1994

[51] Int. Cl.[6] ..... H01H 75/00

[52] U.S. Cl. ..... 335/16; 335/147; 335/195; 218/30

[58] Field of Search ..... 335/16, 147, 195; 200/144 R, 147 R

[56] References Cited

U.S. PATENT DOCUMENTS

| | | | |
|---|---|---|---|
| 4,240,053 | 12/1980 | Nelson et al. . | |
| 4,278,958 | 7/1981 | Kandatsu | 335/16 |
| 4,309,580 | 1/1982 | Wafer et al. . | |
| 4,713,504 | 12/1987 | Maier . | |
| 4,891,617 | 1/1990 | Beatty, Jr. et al. | 335/8 |
| 4,891,618 | 1/1990 | Paton . | |
| 4,996,507 | 2/1991 | McKee et al. | 335/147 |

*Primary Examiner*—Lincoln Donovan
*Attorney, Agent, or Firm*—Martin J. Moran

[57] ABSTRACT

A contact arrangement for a circuit breaker utilizes magnetic attraction between parallel conductors in the movable contacts to open the contacts during a short circuit, high current condition. An elongated, pivotable, main contact arm includes a movable main contact at a first end that engages a fixed main contact in a closed circuit position. An elongated, arcing contact arm, pivotable in the same plane as the main contact arm, includes a movable arcing contact at a first end that engages a fixed main contact in a closed circuit position. The contact arms are spring biased in the closed circuit position such that a gap is defined between the arms. An attractive electromagnetic force tends to keep the first end of the arcing contact arm in contact with the fixed arcing contact until after the main contact arm has lifted. A hinge assembly for the main contact arm and the arcing contact arm assists in opening the contacts during the high current condition. The hinge assembly includes elongated first and second hinge members defining a gap therebetween and providing a second pair of parallel conduction paths for the circuit. The hinge members support the main and arcing contact arms at their second ends distal from the fixed main contacts. The attractive electromagnetic force generated by the parallel currents in the hinge members levers the first ends of the contact arms up from their closed circuit position, thus helping to open the contacts and trip the breaker. The first end of the main contact arm can lift from the fixed main contact with such speed that it knocks the arcing contact arm into the open circuit position.

33 Claims, 6 Drawing Sheets

CONTACT ARRANGEMENT FOR A CIRCUIT BREAKER USING MAGNETIC ATTRACTION FOR HIGH CURRENT TRIP

BACKGROUND OF THE INVENTION

1. Field of the Invention

This invention relates generally to contact arrangements for single pole or multipole circuit breakers, and, more particularly, to contact arrangements that use attractive Lorentz forces between parallel conductors to open the contacts during a high current condition.

2. Description of the Prior Art

Molded case circuit breakers are generally known in the art. An example of such a circuit breaker is disclosed in U.S. Pat. No. 4,891,618, herein included by reference. Such circuit breakers are used to protect electrical circuitry from damage due to a high current condition, such as an overload, a short circuit, or both. An overload current normally is about two to three times the nominal current rating of the circuit breaker. A short circuit may produce currents that are ten or even one hundred times the nominal current rating of the circuit breaker or more.

The contact assemblies of high current circuit breakers generally include stationary, or fixed, main and arcing contacts connected to the line conductor. Movable main and arcing contacts are connected to the load conductor. The arcing contacts should make contact first and break last in order to protect the main contacts from damage due to arcing. The movable main contact is typically disposed on the bottom side of a movable first end of an elongated main contact member, or main contact arm. The second end of the main contact arm is hinged at a pivot point and connected to the load conductor. The movable arcing contact can be disposed on the underside of an arcing contact member, or arcing contact arm, pivotably attached to the first end of the main arcing contact member. In another common type of arrangements, movable contact assemblies are arranged such that a pair of main contact arms are disposed alongside the arcing contact arms.

Overload protection can be provided by a bimetal disposed in series with a load conductor. The bimetal typically consists of two strips of metal having different rates of thermal expansion and bonded together at one end. During a sustained overload the bimetal will deflect due to ohmic heating and engage the circuit breaker trip bar to trip the circuit breaker contacts.

Short circuit protection is typically provided by an electromagnet assembly, by a solid state trip unit, or by magnetic repulsion forces. Electromagnet assemblies, for example, include an electromagnet surrounding a load conductor and a cooperating armature that latches the circuit breaker trip bar during normal conditions. During a short circuit condition the short circuit current passes through the electromagnet which generates attraction forces to attract the armature and unlatch the trip bar which in turn causes the circuit breaker to trip by releasing the movable contact arm, thus opening the contacts.

Magnetic repulsion arrangements, such as disclosed in U.S. Pat. No. 4,891,618, typically consist of flexible shunts formed in generally a U-shape defining two depending legs. The flexible shunts are used to connect the pivotably mounted contact arms to the load conductors. During a short circuit condition, the current flowing in the depending legs of the shunts generates repulsion forces between the depending legs which causes the pivotably mounted contact arms to blow open. It is also well known to provide a U-shaped line side conductor carrying the fixed main and arcing contacts. In this arrangement, the current in the main contact member is directed antiparallel the direction of current flow in the nearby top leg of the U-shaped line side conductor. The oppositely directed currents produce a repulsive force that is proportional to the product of the currents and inversely proportional to the gap between the two conductors. The repulsive force lifts the main contact arm off the fixed main contact at sufficiently high currents.

The mechanisms that are currently used to trip the circuit breaker during a high current condition are very bulky. Electromagnet assemblies require large coil windings for each pole in the circuit breaker. Magnetic repulsion members, such as, for example, the flexible shunts disclosed in U.S. Pat. No. 4,891,618 and also the U-shaped line side conductor, require additional space and produce additional heat within circuit breaker housing.

Since molded case circuit breakers, and, in particular, current limiting molded case circuit breakers are relatively compact, the problem exists to provide higher current limiting capabilities for a circuit breaker in relatively smaller frame sizes. More specifically, the components in a small frame size current limiting molded case circuit breaker cannot merely be increased in size to provide an effective current limiting circuit breaker. Larger components have greater inertia and thus require larger forces to move.

Additionally, currently used short circuit trip mechanisms are relatively slow. Electromagnet assemblies generally take a full cycle to trip the breaker. While magnetic repulsion arrangements and solid state trip mechanisms are somewhat faster than electromagnet assemblies, there is a need for improvement in the speed of opening the arcing contacts after the main contacts are opened.

Further, contact assemblies that have a main contact arm with separate arcing contact arms along either side of the main contact arm can sometimes open the arcing contacts before opening the main contacts, causing premature damage to the main contacts. Therefore, there is the additional need to provide a contact arrangement that assures that the main contacts open before the arcing contacts.

SUMMARY OF THE INVENTION

According to the present invention, a contact arrangement for a circuit breaker includes a fixed main contact located nearby a fixed arcing contact. Each of the fixed contacts are operatively connected to a first terminal of the circuit breaker for making connection to, for example, the line side of the circuit. A movable contact assembly is movable between an open circuit position and a closed circuit position with the fixed main and arcing contacts. A second terminal is operably connected to the movable contact assembly for connecting to, for example, the load side of the circuit.

The movable contact assembly includes a movable main contact that engages the fixed main contact in the closed circuit position. The movable main contact is disposed near a first end of an elongated, preferably substantially flat, main contact arm. The main contact arm is operatively connected near its second end to the second terminal. A movable arcing contact that engages the fixed arcing contact in the closed circuit position is disposed near a first end of an elongated, preferably substantially flat, arcing contact arm that preferably extends beyond the first end of the main contact arm. The second end of the arcing contact arm is positioned in proximity to the second end of the main contact arm and operative connection to the second electrode of the circuit breaker is made near the second end of the arcing contact arm. The main contact arm is positioned between the fixed main contact and the arcing contact arm such that they are angularly spaced apart in a common plane of movement. The main contact arm and the arcing contact arm are retained in position by a hinge arrangement near their second ends. The first ends of each of the main contact arm and the arcing contact arm are thus capable of releasing from the fixed main and arcing contacts, respectively, while the arms pivot about relatively fixed positions near the second ends thereof. A contact arm bias arrangement biases the movable main contact into engagement with the fixed main contact in the closed circuit position such that the main contact arm and the arcing contact arm provide parallel condition paths for the circuit current between the first and second electrodes when the contacts are in their closed circuit positions.

A current in each arm generates a magnetic field that interacts with the current in the other arm to produce an attractive electromagnetic Lorentz force between the two arms. The arcing contact arm experiences a force that tends to keep the movable arcing contact down in engagement with the fixed arcing contact, while the main contact arm experiences a force that tends to lift it away from the fixed main contact and towards the arcing contact. When the current exceeds a predetermined value, such as that experienced during a very high current short circuit condition, the force is sufficient to assist in lifting up the first end of the main contact arm, disengaging the movable main contact from the fixed main contact while the movable arcing contact stays in engagement with the fixed arcing contact. At sufficiently high current levels, the first end of the main contact arm may release with such speed that it will hit the arcing contact arm with an impulse capable of moving the arcing contact arm and disengaging the arcing contacts at speed.

According to one aspect of the invention, the attractive electromagnetic force provides the entire force necessary to lift the main and arcing contact arms during a high current condition. According to other aspects of the invention, the attractive force is assisted by other mechanisms for lifting the main contact arm, or the arcing contact arm, or both during a short circuit condition. The other mechanisms can be a magnetic repulsion arrangement provided by, for example, a U-shaped line side conductor connecting the fixed main and arcing contacts to the first terminal, or other systems well known in the art. In addition, the hinge arrangement may also utilize an attractive electromagnetic force between two parallel conductors to assist in opening the contacts.

According to another aspect of the invention, the contact arm bias arrangement includes a link member located between the hinge arrangement and the movable main contact by which the arms are mechanically positioned between the open and closed circuit positions. The link member includes a support member spaced apart from a first side of the arcing contact arm that is distal from the main contact arm, a retention member proximate a first side of the main contact arm that is distal from the arcing contact arm, and a connecting member connecting the support member and the retention member, preferably a pin slidably extending through aligned holes in the main and arcing contact arms. A first bias spring, such as a coil spring slidably extending through the hole in the arcing contact arm biases the main contact arm away from the support member. A second bias spring, such as a coil spring, biases the arcing contact arm away from the support member such that the retention member is spaced apart from the first side of the main contact arm.

The hinge arrangement, according to one aspect of the invention, includes elongated, substantially flat, first and second hinge members defining a hinge gap therebetween and providing parallel conduction paths between the second terminal and the main and arcing contact arms. The attractive electromagnetic force between the hinge members generated by the parallel currents assists in lifting the first ends of the main and arcing contact arms, thus helping to open the pairs of main and arcing contacts. The first hinge member has a first end supporting the main contact arm at a support position spaced apart from the second end of the main contact arm and distal from the movable main contact, and is operably connected to the second terminal near a second end. A lever portion of the main contact arm that extends beyond the support position and that includes the second end of the main contact arm is positioned between a first end of the second hinge member and the first hinge member. The second end of the second hinge member is fastened to the second end of the first hinge member and is also operably connected to the second terminal. The second hinge member contacts the arcing contact arm near the support position. The first and second hinge members are spring biased together to hold the arrangement in place. The attractive electromagnetic force between the hinge members exerts a levering force on the lever portion of the main contact arm for moving the movable main contact away from the fixed main contact during a high current condition.

In a first preferred arrangement, the first hinge member is a resilient member having a first side supporting the first side of the main contact arm. The lever portion of the main contact arm is an elbow defining an obtuse included angle and extending away from the first hinge member. The outer surface of the elbow provides a fulcrum for levering the first end of the main contact arm. The second hinge member has a hook at a first end that engages the elbow. Thus, the elbow is sandwiched between the hook on the second hinge member and the flat first side near the first end of the first hinge member. The second end of the arcing contact arm is supported by the hook. A second contact arm bias arrangement, such as a spring, is provided for spring biasing the second ends of the main and arcing contact arms together to grasp the hook such that a gap is maintained between the contact arms. The attractive electromagnetic force generated by parallel currents in the first and second hinge members will force the hook down on the lever arm provided by the elbow and thereby assist in lifting the first end of the main contact member from the fixed main contact.

In a second preferred arrangement of the hinge, the fixed, L-shaped, first hinge member includes a first leg, including the first end, providing a pivot for the main contact arm, and also includes a second leg extending about in parallel with the main contact arm in the closed circuit position and operatively connected to the second terminal near the second end. Part of the second end of the arcing contact arm, which is supported by the lever portion of the main contact arm, overhangs the pivot. The second hinge member, which is somewhat resilient, has a first side near a first end supported by a portion of the arcing contact arm that overhangs the support point and is supported by the lever portion of the main contact arm. During a high current condition, such as experienced during a short circuit, an attractive electromagnetic force will be generated between the first and second hinge members, bringing the first end of the first hinge member down towards the fixed first hinge member and forcing the supporting portion of the arcing contact arm down. Because the main and arcing contact arms are mechanically connected by the contact arm bias arrangement, the first ends of both contact arms are assisted in lifting off the fixed contacts to open the circuit.

According to another aspect of this invention, a hinge arrangement, such as any of the arrangements described above, operates on a single contact arm to disengage a movable contact near a first end of the contact arm from engagement with a fixed contact in response to a high current condition.

It is an object of this invention to provide a contact arrangement for a circuit breaker that assures that the main contacts open before the arcing contacts.

It is another object of this invention to provide a contact arrangement for a circuit breaker that is fast acting in response to a high current condition.

It is another object of this invention to provide a contact arrangement for a circuit breaker that is compact.

It is another object of this invention to provide a contact arrangement wherein an attractive magnetic force generated by parallel currents in the contact arrangement provide a force sufficient to activate a high current trip mechanism in a circuit breaker.

It is another object of this invention to provide a circuit breaker that has a hinge mechanism for main and arcing contact arms that assists in opening the main and arcing contacts during a high current condition.

These and other objects of the present invention will be more fully understood from the following description of the invention with reference to the illustrations appended hereto.

DETAILED DESCRIPTION OF THE PREFERRED EMBODIMENTS

Figure 1:
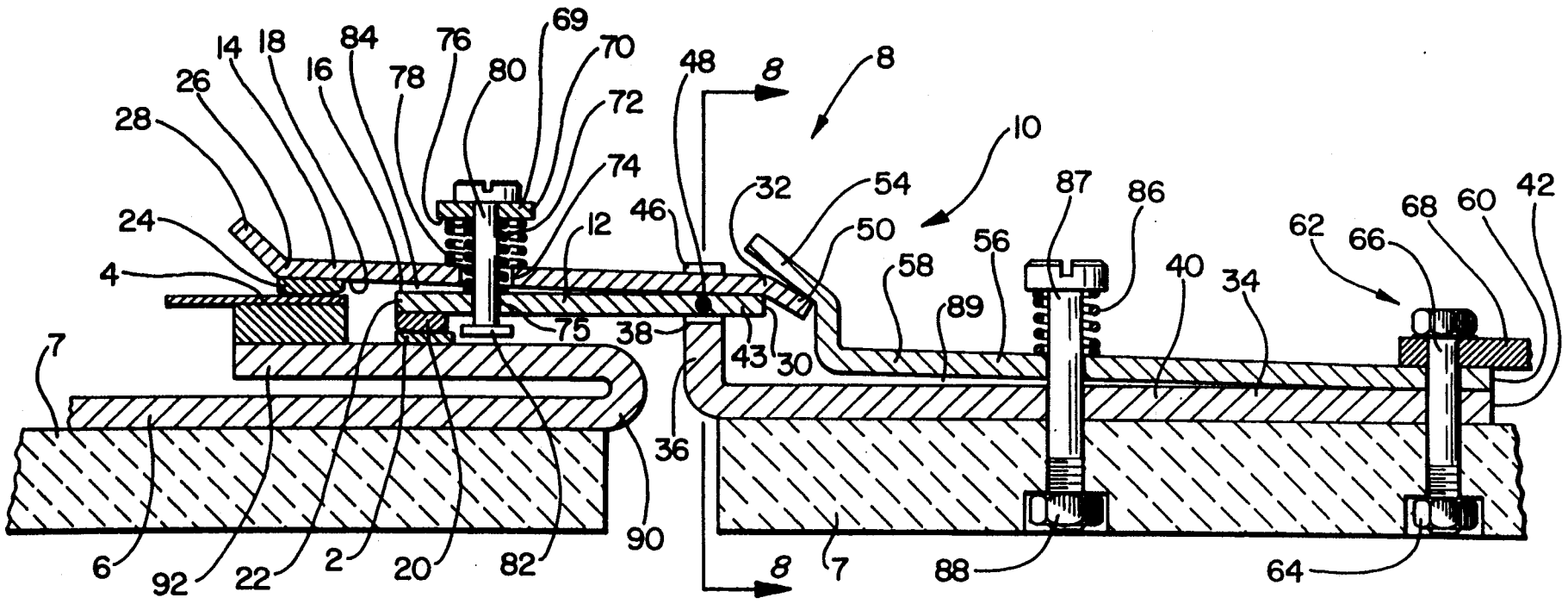
FIG. 1 is an elevation side view of a preferred embodiment of a contact arrangement of this invention in the closed circuit position.
Figure 2:
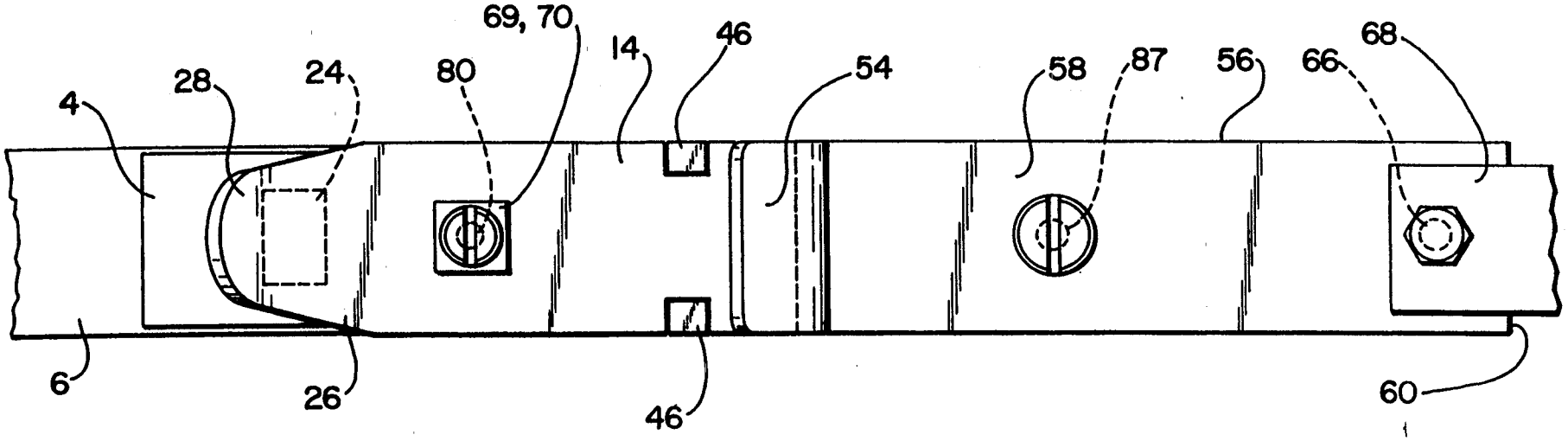
FIG. 2 is a plan view of the contact arrangement of FIG. 1.

The contact arrangement for a circuit breaker of the present invention uses the attractive electromagnetic force between two parallel conductors carrying current in the same direction to interrupt a short circuit current. This is carried out in the preferred embodiments by passing the parallel currents through movable main and arcing contact arms, wherein the main contact arm is lifted off a fixed main contact towards the arcing contact by the attractive electromagnetic force while the arcing contact arm is held in a closed circuit position.

It is well known that the Lorentz force between two nearby lengths of straight conductors carrying parallel currents is given by the expression:

$$F = k\frac{I_1 I_2}{d} L$$

where F is the magnetic force in dynes, k is a constant about equal to 0.02, $I_1$ is the current in the first conductor in amperes, $I_2$ is the current in the second conductor, L is the length of the conductors in cm, and d is the separation between the currents in cm. If the currents are directed oppositely, the force is repulsive; if the currents are in the same direction, the force is attractive. The Lorentz forces generated by parallel currents can be substantial. For example, the force acting on each of two parallel conductors carrying a total current of 10,000A, wherein $I_1=7{,}000$A, $I_2=3{,}000$A, $d=0.5$ cm and $L=5$ cm, is about 4,200,000 dynes (9.43 pounds). The currents, which initially may be distributed in each of the conductors, will be motivated to the confronting surfaces of the conductors by the Lorentz force. Therefore, one can make the assumption that the currents will be located near the confronting surfaces, and d is then almost as small as the gap between the surfaces.

Repulsive Lorentz forces generated between antiparallel currents have been used in the prior art to open contacts in response to short circuit currents. The advantage of the attractive Lorentz force used by the present invention is that the force increases as the conductors move closer under the influence of the force, whereas repulsive forces decrease in magnitude when the conductors move apart under the force.

A contact arrangement for a circuit breaker of this invention is typically located in a molded case circuit breaker having well known mechanisms for latching the contacts in a closed circuit position, in a trip position and an off position. Linkage mechanisms between the operating mechanism and the contact arms are also well known. The circuit breaker may include a single pole or as many as four poles carrying three different phases of alternating current and a neutral. These features common to circuit breakers in general will not be discussed further in detail.

FIGS. 1–3 and 8 illustrate a preferred embodiment of a contact arrangement of this invention. For convenience and simplicity of exposition, the following discussion refers to only one circuit, e.g. a single pole. However, it is to be understood that similar arrangements are provided for each pole of a multi-pole circuit breaker, wherein each pole constitutes a separate circuit and wherein a cross bar connecting each of the separate contact arrangements together and also linked to the operating mechanism of the breaker can be provided to trip all the poles if one or more poles experience a high current condition. The contact arrangement includes a fixed main contact 2 and a nearby fixed arcing contact 4, each connected to a connecting conductor 6 operatively connected to one of the breaker terminals (not shown), provided for connection to, for example, the line side of the circuit. The connecting conductor 6 is typically mounted onto an insulating base 7 of the breaker case. The other breaker terminal (not shown), provided for connection to, for example, the load side of the circuit, is operatively connected to a movable contact arrangement 8 that includes a hinge arrangement 10 providing support for a conducting main contact arm 12 and a conducting arcing contact arm 14.

The main and arcing contact arms are each elongated, substantially flat members aligned such that an upper side 16 of the main contact arm 12 faces a lower side 18 of the arcing contact arm 14. The main contact arm 12 has a movable main contact 20 on its underside near a first end 22, located distal from the hinge, that engages the fixed main contact 2 in a closed circuit position of the breaker. (see FIG. 1) Similarly, there is a movable arcing contact 24 on the lower side near a first end 26 of the arcing contact arm 14 for engaging the fixed arcing contact 4 in the closed circuit position. The main contact arm 12 is positioned between the arcing contact arm 14 above and the fixed main contact 2 below. The first end 26 of the arcing contact arm overhangs the first end 22 of the main contact arm to reach the fixed arcing contact 4. For the main contact arm 12 to lift and extend into the open circuit position (see FIG. 3), the arcing contact arm 14 must also lift up from its closed circuit position. As can be appreciated from the figures, the main and arcing contact arms are angularly spaced in a common plane of movement. A first extension 28 on the first end 26 of the arcing contact arm is for transferring the arc to a plurality of spaced apart metal plates in an arc chute (not shown), a well known mechanism for smoothly extinguishing the arc with small voltage drops during a high current trip.

The main contact arm 12 and the arcing contact arm 14 are supported at a support position near their second ends 30, 32 by the hinge arrangement 10. In the preferred embodiment illustrated in FIGS. 1–3, the hinge arrangement includes an L-shaped, fixed, conducting, bottom, first hinge member 34 having a vertical first leg 36 extending to a first end 38 and a horizontal second leg 40 supported by the insulating base 7 and extending to a second end The vertical leg 36 pivotally supports the main contact arm 12 near the main contact arm second end 30 such that a short length of the main contact arm forming a lever portion 43 extends beyond the vertical leg 36 as illustrated. The vertical leg 36 has a notch 44 defined by two peripheral arms 46 extending vertically up from the first end 38 of the bottom hinge member (see FIG. 8). A pivot connection can be provided by, for example, a pivot pin 48 extending between the peripheral arms 46 and through a hole in the main contact arm 12. However, the pivot pin 48 is not necessary. Alternatively, the main contact arm 12 can be pivotally supported by the horizontally extending surface 49 of the first end The arcing contact arm 14 is supported near its second end 32 by the lever portion 43 of the main contact arm 12. A second extension, or lever portion 50, of the arcing contact arm 14 angles down over the second end 30 of the main contact arm 12 and supports an upwardly angled first end 54 of a resilient, conducting, top second hinge member 56. The second hinge member 56 extends about vertically downward therefrom to an about horizontal leg 58 extending to a second end 60. The hinge members are connected together near their second ends by a fastener 62, such as a nut 64 and bolt 66, and are also operatively connected by a connecting conductor 68 to the second terminal. Such connection can be made with, for example, a section of flexible copper braid, a conducting cable, or other arrangements known in the art.

A contact arm bias arrangement spring biases the movable main contact 20 into positive engagement with the fixed main contact 2 and spring biases the movable arcing contact 24 into positive engagement with the fixed arcing contact 4 in the closed circuit position. The contact arm bias arrangement in this embodiment includes a link member 69 located between the contact arms 12 and 14 and the breaker mechanism. The link member 69 is typically connected to a breaker latching mechanism (not shown) by which the arms 12, 14 are mechanically positioned between open circuit and closed circuit positions. The link member 69 in this preferred embodiment has a support member 70 spaced apart from the upper side 16 of the arcing contact arm. The support member 70 is connected to a connecting member 80, such as pin, slidably extending through a hole 74 in the arcing contact arm aligned with a hole 75 in the main contact arm. The opposite end of the connecting member 80 is connected to a retention member positioned proximate the lower side of the main contact arm. A first bias spring, such as a first coil spring extends through the hole 74 in the arcing contact arm 14 from a support surface 76 of the link member to the upper side 16 of the main contact arm, and spring biases the main contact arm downward such that the main contacts 2, 20 are engaged during normal current conditions in the closed circuit position. A second bias mechanism, provided in this example by a second coil spring 78 coaxially aligned with the first coil spring 72, spring biases the arcing contact arm 14 downward such that the arcing contacts 4, 24 are engaged for normal currents in the closed circuit position. The connecting member 80 helps to keep the contact arms and coil springs in alignment. The main contacts 2, 20 and arcing contacts 4, 24 are positioned such that a wedge-shaped contact arm gap 84 is formed between the main contact arm 12 and arcing contact arm 14 and the retention member 82 is spaced from the main contact arm 12 in the closed circuit position. The hinge members 34, 56 are spring biased together by a hinge bias arrangement. This is simply provided by, for example, a third coil spring 86, extending between the head of a bolt 87 and the top, second hinge member 56, wherein the bolt 87 extends through aligned holes in the first and second hinge members and is adjustably retained by a nut 88. The horizontal legs of the first and second hinge members define a wedge-shaped hinge member gap 89 therebetween.

The gapped apart main and arcing contact arms 12, 14 provide parallel current paths for the circuit current causing an attractive Lorentz force between them tending to hold the movable arcing contact 24 down on the fixed arcing contact 4 and tending to motivate the main contact 12 arm up so as to disengage the main contacts 2, 20. However, during normal current conditions within the rated operating range of the breaker, the main contact arm 12 is held in the closed circuit position by the first coil spring 72 and by spring tension in the breaker latching mechanism. During a short circuit condition, the current through each of the contact arms 12, 14 will rapidly increase and thereby increase the attractive force between them. When the currents are strong enough to create a force sufficient to overcome the spring forces, the first end 22 of the main contact arm will lift, disengaging the movable main contact 20 from the fixed main contact, while the movable arcing contact 24 remains, for the moment, in engagement with the fixed arcing contact 4.

There is also an attractive force between the horizontal legs 40, 58 of the first and second hinge members 34, 56 because of the parallel currents that they carry. Because the first hinge member 34 is fixed in position, the relatively resilient second hinge member 56 will flex down towards the bottom hinge member. During a high current condition, the angled first end 54 of the top, second hinge member 56 will press down upon the angled lever portion 50 of the arcing contact arm 14. The arcing contact arm 14 is supported on the lever portion 43 of the main contact arm 12 such that both second ends of the contact arms extend beyond the pivot provided in this embodiment by the pivot pin 48. The downward force from the second hinge member 56 on the lever portions 43, 50 of the contact arms levers their first ends 22, 26 up, assisting in opening the contacts. This action will increase as the short circuit current increases for two reasons. First, the short circuit currents generally increase rapidly and this increases the Lorentz force because the Lorentz force is proportional to the product of the currents in the two conductors. Second, the Lorentz force is inversely proportional to the gap between the parallel conductors, and as the attractive force increases, the second hinge member will flex down towards the first hinge member, narrowing the gap.

Figure 3:
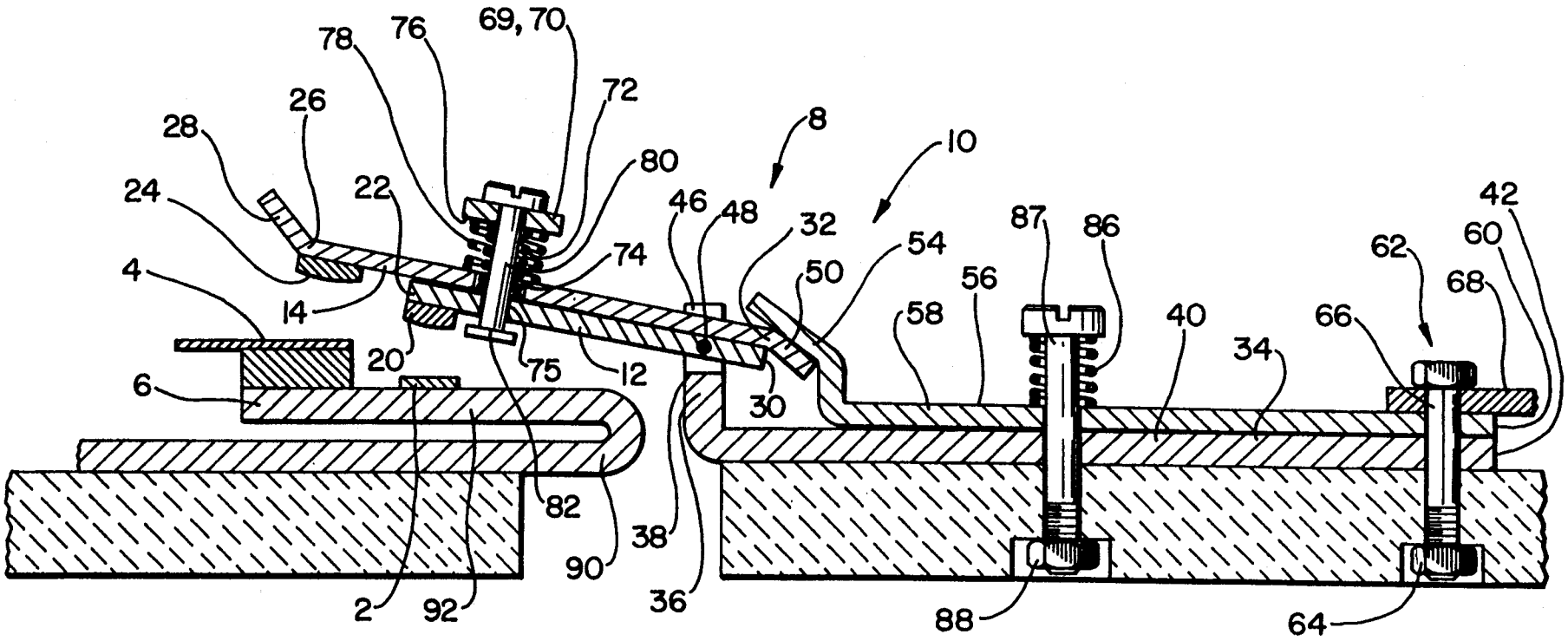
FIG. 3 is an elevation view of the contact arrangement of FIG. 1 in a tripped open circuit position.
Figure 4:
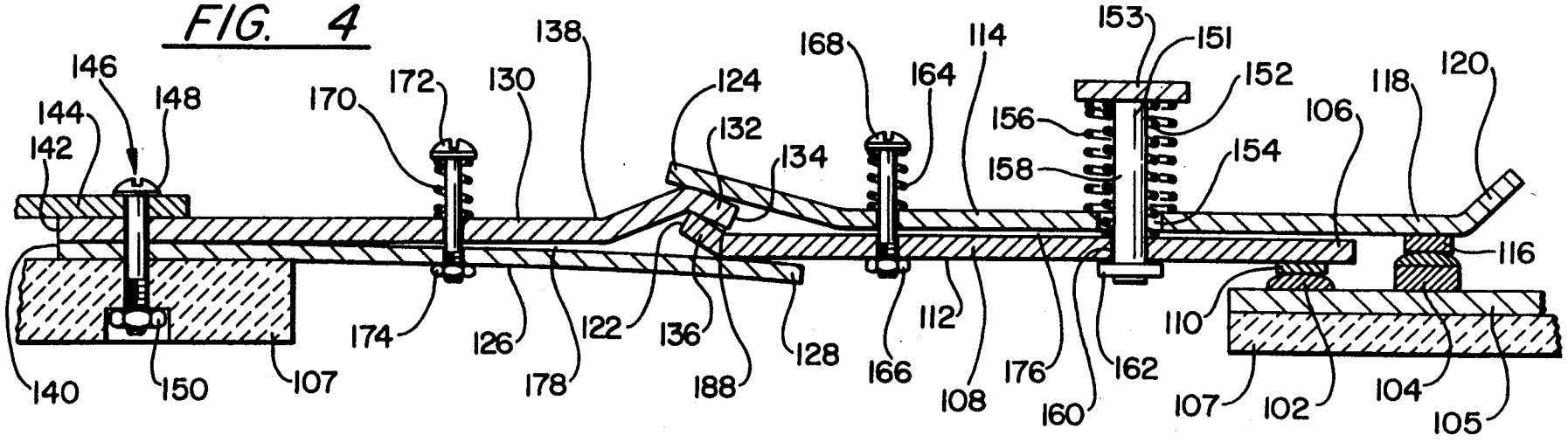
FIG. 4 is an elevation side view of a preferred embodiment of the contact arrangement of this invention having a hinge arrangement different from that shown in FIG. 3.
Figure 5:
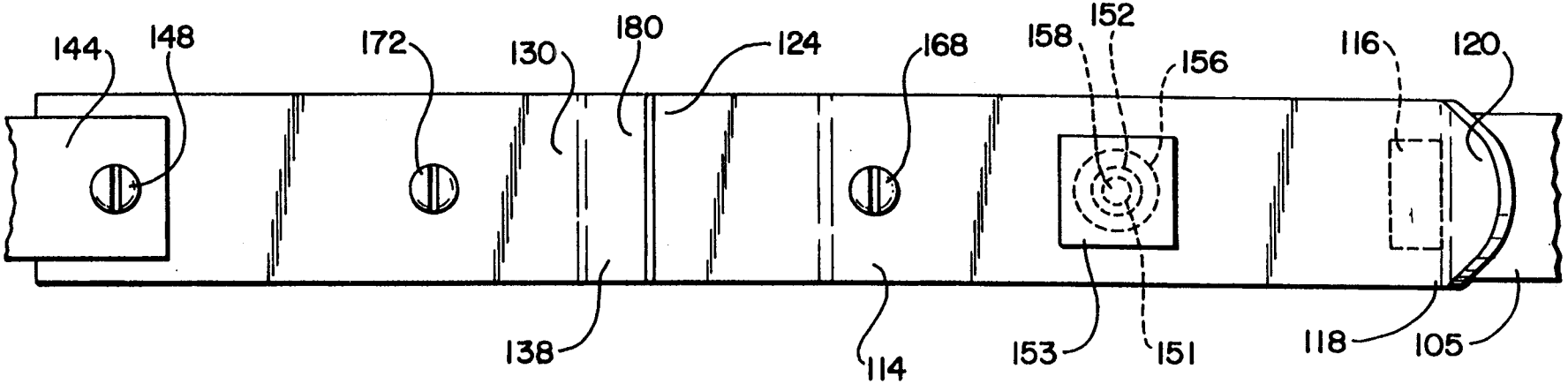
FIG. 5 is a plan view of the contact arrangement of FIG. 4.
Figure 6:
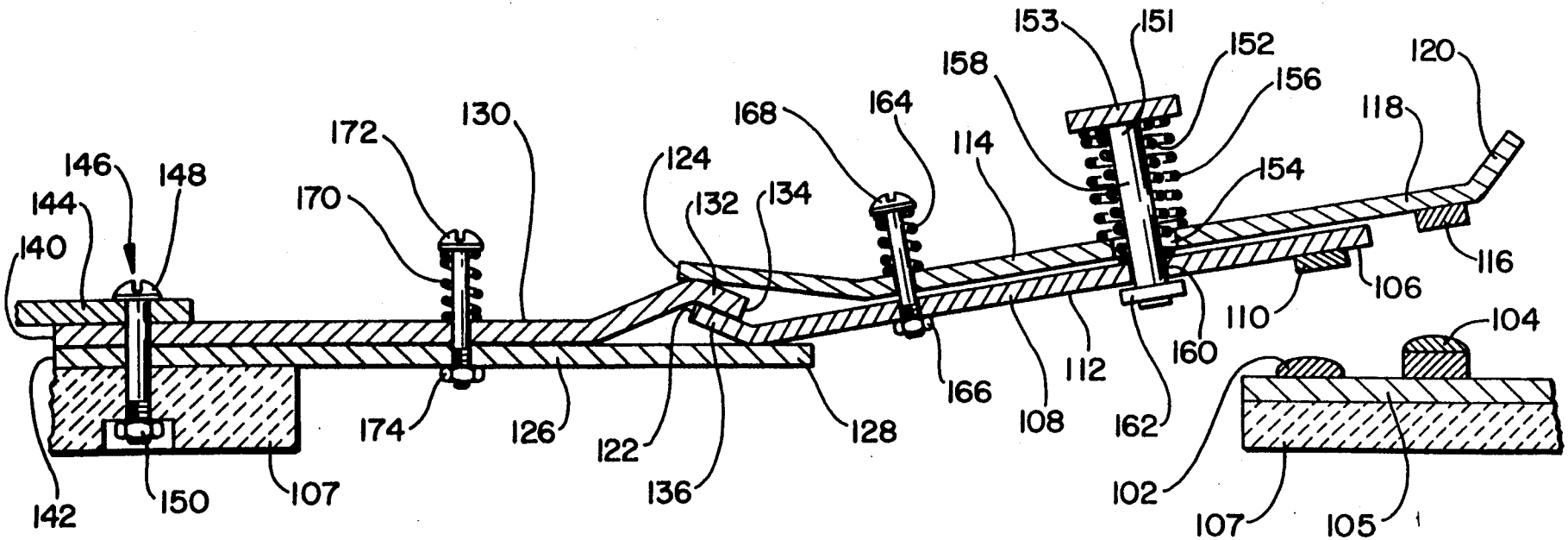
FIG. 6 is an elevation view of the contact arrangement of FIG. 4 in a tripped open circuit position.

The contact arrangement may include a U-shaped, conducting repulsion member 90 connecting the fixed main and arcing contacts 2, 4 to the first breaker terminal, as depicted in FIGS. 1 and 3. The top leg 92 of the U-shaped repulsion member 90 will carry the circuit current in a direction antiparallel to that carried by the main and arcing contact arms 12, 14. As discussed above, antiparallel currents will cause a repulsive Lorentz force between the spaced apart current carriers. Therefore, a high current condition will assist in lifting the contact arms 12, 14 and thereby help to open the main contacts 2, 20 and then the arcing contacts 2, 24 and trip the breaker.

A different preferred embodiment of the invention is illustrated in FIGS. 4–7. This contact arrangement, similar to that described above, includes fixed main 12 and arcing 104 contacts positioned nearby one another, each operatively connected by a connecting member 105 to a first breaker terminal (not shown). The connecting member 105 is attached by a fastening arrangement (not shown) to an insulating base 107 of the breaker. Proximate the fixed main contact 102 is a first end 106 of an elongated, substantially flat, conducting main contact arm 108 carrying a movable main contact 110 on its lower, first side 112 near the first end 106 for engagement with the fixed main contact 102 in the closed circuit position. Angularly spaced above the main contact arm 108 in a common plane of movement is an elongated, substantially flat sided, conducting arcing contact arm 114 having a movable arcing contact 116 near a first end 118 that extends beyond the first end 106 of the main contact arm 108 and engages the fixed arcing contact 104 in the closed circuit position. A first angled extension 120 on the first end 118 of the arcing contact arm is provided for transferring the arc to a plurality of spaced apart plates in an arc chute (not shown). The main and the arcing contact arms 108, 114 are each operatively connected near their second ends 122, 124 to the second breaker terminal (not shown).

The operative connection to the second breaker terminal includes a hinge arrangement different from that described in the first embodiment above. The hinge arrangement includes a substantially flat sided, bottom, first hinge member 126 supporting the main contact arm 108 at a support position near the first end 128 of the first hinge member 126. A substantially flat sided, top, second hinge member 130 has a downward facing hook 132 at a first end 134 that engages an upwardly angled elbow 136 on the second end 122 of the main contact arm. The upward angled second end 124 of the arcing contact arm is supported by the upper side 138 of the top hinge member 130 at the hook 132. The first and second hinge members 126, 130 are operatively connected near their second ends 140, 142 to the second terminal by electrical connection 144 that can include, for example, a flexible copper braid, a bus bar or other suitable electrical connectors capable of carrying high currents without excessive ohmic heating. The electrical connection 144 is connected to the top and bottom hinge members by a fastener 146, such as a bolt and nut 150, that also serves to clamp the second ends of the hinge members 140, 142 against each other.

Similar to the first embodiment of the invention described above and shown in FIGS. 1–3 and 8, this contact arrangement has a first bias arrangement that preferably includes a link member 151 located between the movable main contact 110 and the break mechanism. The link member 151 is typically connected to a breaker latching mechanism (not shown) by which the arms 108, 114 are mechanically positioned between open circuit and closed circuit positions. The first bias arrangement spring biases the main contact arm 108 and the arcing contact arm 114 down such that the movable main contact 110 and the movable arcing contact are in positive engagement with the fixed main contact 102 and the fixed arcing contact 104, respectively, when the breaker is in the closed circuit position. The first bias arrangement preferably includes a first coil spring 152 that extends between a support member 153 and the main contact arm 108 through a hole in the arcing contact arm 114. A second coil spring extends between the support member and the arcing contact arm 114. The first and second coil springs 152, 156 are coaxially aligned with a connector pin 158 extending through the hole 154 in the arcing contact arm and a hole 160 in the main contact arm. The pin connects the support member 153 above the arcing contact arm to a retention member 162 below the main contact arm. The retention member 162 is spaced slightly apart from the arcing contact arm 108 in the closed circuit position by the positive action of the the linkage mechanism acting on the link member 151. A second bias arrangement between the support position and the first bias arrangement spring biases the second ends 122, 124 of the contact arms together to grasp the hook 132 therebetween. The second bias arrangement preferably includes a third coil spring 164 and a nut 166 and bolt 168.

The hinge arrangement also includes a hinge bias arrangement for spring biasing the first ends 128, 134 of the first and second hinge members 126, 130 together so as to clasp the elbow 136. It is preferred that the hinge bias arrangement include a fourth coil spring 170 extending between the head of a bolt 172 secured by a nut 174 and the second hinge member 130. In this arrangement, the bolt 172 extends through aligned holes in the first and second hinge members.

There is a contact arm gap 176 between the main and arcing contact arms when they are in the closed circuit position, thereby providing a first pair of parallel conduction paths for the breaker circuit. There is also a wedge-shaped hinge member gap 178 between the first and second hinge members, providing a second pair of parallel conduction paths when the breaker is closed circuit. The action of the first pair of parallel conductors in lifting the main contact arm and then the arcing contact arm to cause a trip during a high current condition is similar to the action described above for the first preferred embodiment of the invention. The action of the hinge arrangement, however, is somewhat different.

Figure 7:
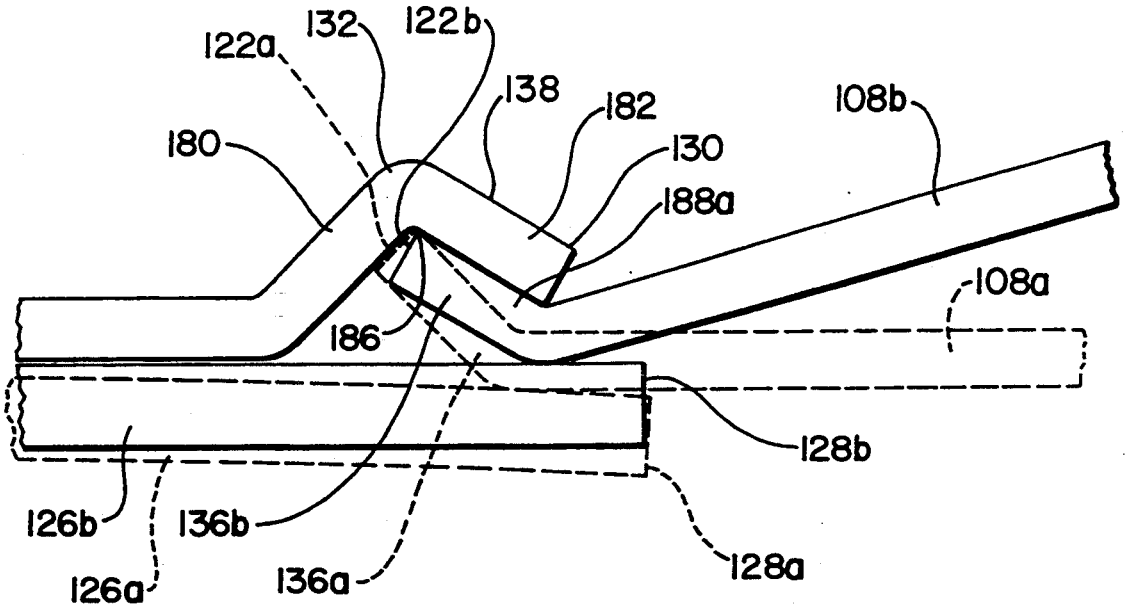
FIG. 7 is a detail of the hinge connection of the contact arrangement of FIGS. 4–6.
Figure 8:
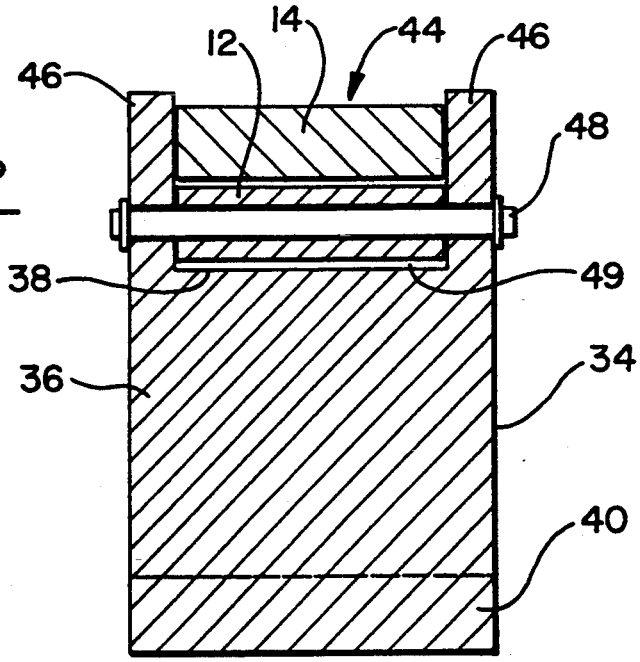
FIG. 8 is a cross section through line 8—8 of FIG. 1 showing a detail of a preferred embodiment of a hinge arrangement.

Referring now to FIG. 7, a detail of the connection between the bottom, first and top, second hinge members 126, 130 and the elbow 136 is illustrated in both the closed circuit and in the high current trip, open circuit position. Components in the closed circuit position are referenced with a label "a" after the numerical reference label in the figure, and components in the open circuit position are referenced with a label "b" after the numerical reference label. For simplicity of illustration, the arcing contact arm is not shown in FIG. 7. The hook 132 of the second hinge member 130 has a first segment 180 angled about up from the horizontal, and a second segment 182 angled down therefrom and forming an included angle with the first segment that is greater than about 90°, and preferably about 120°. In the closed circuit position, the main contact arm 108 is substantially horizontal except for an upwardly angled segment forming the elbow 136 at the second end. The elbow 136 forms an included angle that is also greater than about 90°, and preferably about 120°. In the closed circuit position there is a wedge-shaped lever gap Lee formed between an upper surface of the elbow 136 and the second segment 182. The distal edge 184 or end of the elbow 136 rests against a crease 186 in the hook between the first and second segments 180, 182 of the hook 132. The elbow's lower side is preferably rounded. The first end 128 of the first hinge member 126 is resiliently deflected down from the horizontal in this position by the elbow pressing down upon it.

During a high current condition an attractive electromagnetic Lorentz force between the first and second hinge members 126, 130 will tend to close the hinge member gap 178 therebetween, bringing their first ends 128, 134 closer together. The elbow 136 of the main contact arm 108 acts as a lever and is forced down until the gap is about closed in the open circuit position. This will cause a lifting of the first end 106 of the main contact arm 108 by about 30° from the horizontal. In addition, Lorentz attraction force between the main and arcing contact arms 108, 114 will initially cause the angled second end 124 of the arcing contact arm to press downward upon the upper side 138 of the top hinge member increasing the levering on the main contact arm Thus, the action of the hinge arrangement assists in opening the contacts.

The materials used for fabricating the contact arms, the hinge members and the contacts are well known in the art. The contact arms and the hinge members should be good conductors, such as copper or a copper alloy or composite. The contacts are preferably made of a AgW alloy. The main contacts have a mixture that is about 90% by weight silver; the arcing contacts are about 35% by weight silver. The current rating of the breaker and choice of material dictate the cross sectional areas of each of the contact arms and the hinge members. For example, a nominal 250A breaker can be designed with copper contact arms and hinge members that are about 0.25 inch (0.635 cm) thick and about 1 inch (2.54 cm) wide because copper can carry a current of about 1000A/in$^2$ (155 A/cm$^2$) without significant heating.

There are several advantages to the present invention over the prior art. The attractive Lorentz forces between the contact arms and between the hinge members can cause the main contact arm to lift with extreme speed in both of the embodiments described herein. The main contact arm may even bump the arcing contact arm with sufficient impulsive force so as to overcome the bias force of the second coil spring and open the arcing contacts at speed. This will enable high current trips with more rapidity than is currently available with magnetic repulsion forces alone. In addition, magnetic repulsion forces decrease as the conductors separate, whereas the hinge arrangement provides an increasing attractive force as the contacts open. This accelerates the action of the hinge mechanisms in a high current condition, further increasing the speed of circuit interruption. The second described embodiment of the invention has the additional advantage that it takes up very little space because the bottom hinge member is flat rather than L-shaped.

While terms such as "above," "below," "upper," "lower," "up," "down" and other relative positional terms have been used for convenience of description of the preferred embodiments of the invention, these terms are not intended to be absolute and limiting. It should be understood that other orientations of contact arrangements retaining equivalent positional relationships between the component parts are also encompassed by the invention.

Whereas particular embodiments of the present invention have been described above for purposes of illustration, it will be appreciated by those skilled in the art that numerous variations of the details may be made without departing from the invention as described in the appended claims.

I claim:

1. A contact arrangement for a circuit breaker, including a fixed main contact located nearby a fixed arcing contact, first terminal means for operatively connecting the fixed main and fixed arcing contacts to a first terminal of the breaker, a movable contact assembly movable between a closed circuit position and an open circuit position with the fixed main and arcing contacts, second terminal means for operably connecting the movable contact assembly to a second terminal of the breaker, wherein the movable contact assembly comprises:

an elongated, conducting, main contact arm, including a movable main contact near a first end;

an elongated, conducting arcing contact arm angularly spaced from the main contact arm and distal from the fixed main contact in a common plane of movement of the main contact arm and the arcing contact arm, including a movable arcing contact near a first end;

hinge means for operably connecting the main contact arm and the arcing contact arm to the second terminal near a second end of each and for providing support for the main contact arm and the arcing contact arm near their second ends; and first bias means for spring biasing the movable main contact into engagement with the fixed main contact in the closed circuit position and for spring biasing the movable arcing contact into engagement with the fixed arcing contact in the closed circuit position such that the main contact arm and the arcing contact arm provide spaced apart, parallel conduction paths in the closed circuit position, wherein a high current condition generates an attractive electromagnetic force therebetween for moving the first end of the main contact arm in the plane of movement so as to disengage the movable main contact from the fixed main contact before the movable arcing contact disengages from the fixed arcing contact.

2. The contact arrangement of claim 1, wherein the first bias means includes:

a link member located between the hinge means and the movable main contact and by which the arms are mechanically positioned between the closed circuit and open circuit positions, comprising a support member spaced apart from a first side of the arcing contact arm that is distal from the main contact arm, a retention member proximate a first side of the main contact arm that is distal from the arcing contact arm, and a connecting member connecting the support member and the retention member;

a first bias spring biasing the main contact arm away from the support member; and a second bias spring biasing the arcing contact arm away from the support member, wherein the retention member is spaced apart from the first side of the main contact arm in the closed circuit position.

3. The contact arrangement of claim 2, wherein the first bias means is characterized in that:

the first bias spring is a first coil spring extending through a first hole in the arcing contact arm and between the support member and a second side of the main contact arm;

the second bias spring is a second coil spring extending between the support member and the first side of the arcing contact arm; and the connecting member is a pin slidably extending through the first hole and through a second hole in the main contact arm that is aligned with the first hole.

4. The contact arrangement of claim 2, wherein the hinge means includes:

an elongated, conducting, first hinge member, comprising a first end supporting the main contact member at a support position spaced apart from the second end of the main contact arm and distal from the movable main contact, and a second end connected to the second terminal means;

an elongated, conducting, second hinge member, comprising a first end, and a second end connected to the second terminal means, wherein the second hinge member contacts the arcing contact arm near the second end of the arcing contact arm, wherein a lever portion of the main contact arm extending beyond the support point and including the second end of the main contact arm is positioned between the first ends of the second hinge member and the first hinge member;

fastening means for fixing the second ends of the hinge members in close proximity to each other; and second bias means for spring biasing the first ends of the first and second hinge-members towards each other such that the hinge members provide spaced apart parallel conduction paths in the closed circuit position, wherein the high current condition generates a second attractive electromagnetic force between the hinge members for exerting a levering force on the lever portion for moving the movable main contact in the plane of motion away from the fixed main contact.

5. A contact arrangement for a circuit breaker, including a fixed main contact located nearby a fixed arcing contact, first terminal means tier operatively connecting the fixed main and fixed arcing contacts to a first terminal of the breaker, a movable contact assembly movable between a closed circuit position and an open circuit position with the fixed main and arcing contacts, second terminal means for operably connecting the movable contact assembly to a second terminal of the breaker, wherein the movable contact assembly comprises:

an elongated, conducting arcing contact arm angularly spaced from the main contact arm and distal from the fixed main contact in a common plane of movement of the main contact arm and the arcing contact arm, including a movable arcing contact near a first end;

hinge means for operably connecting the main contact arm and the arcing contact arm to the second terminal near a second end of each and for providing support for the main contact arm and the arcing contact arm near their second ends;

first bias means for spring biasing the movable main contact into engagement with the fixed main contact in the closed circuit position and for spring biasing the movable arcing contact into engagement with the fixed arcing contact in the closed circuit position such that the main contact arm and the arcing contact arm provide spaced apart, parallel conduction paths in the closed circuit position, wherein a high current condition generates an attractive electromagnetic force therebetween for moving the first end of the main contact arm in the plane of movement so as to disengage the movable main contact from the fixed main contact before the movable arcing contact disengages from the fixed arcing contact;

wherein the first bias means includes:

a link member located between the hinge means and the movable main contact and by which the arms are mechanically positioned between the closed circuit and open circuit positions, comprising a support member spaced apart from a first side of the arcing contact arm that is distal from the main contact arm, a retention member proximate a first side of the main contact arm that is distal from the arcing contact arm, and a connecting member connecting the support member and the retention member;

a first bias spring biasing the main contact arm away from the support member;

a second bias spring biasing the arcing contact arm away from the support member, wherein the retention member is spaced apart from the first side of the main contact arm in the closed circuit position:

wherein the hinge means includes:

an elongated, conducting, first hinge member, comprising a first end supporting the main contact member at a support position spaced apart from the second end of the main contact arm and distal from the movable main contact, and a second end connected to the second terminal means:

an elongated, conducting, second hinge member, comprising a first end, and a second end connected to the second terminal means, wherein the second hinge member contacts the arcing contact arm near the second end of the arcing contact arm, wherein a lever portion of the main contact arm extending beyond the support point and including the second end of the main contact arm is positioned between the first ends of the second hinge member and the first hinge member;

fastening means for fixing the second ends of the hinge members in close proximity to each other; and second bias means for spring biasing the first ends of the first and second hinge members towards each other such that the hinge members provide spaced apart parallel conduction paths in the closed circuit position, wherein the high current condition generates a second attractive electromagnetic force between the hinge members for exerting a levering force on the lever portion for moving the movable main contact in the plane of motion away from the fixed main contact.

6. The contact arrangement of claim 5, wherein the first hinge member is an L-shaped member further comprising a first leg that includes the first end oriented about perpendicular to the main contact arm in the closed circuit position, and a second leg that includes the second end oriented about parallel with the main contact arm in the closed circuit position.

7. The contact arrangement of claim 6, characterized in that the second hinge member further comprises an angled first leg that includes the first end and that exerts a levering force on an angled extension of the arcing contact arm overhanging the second end of the main contact arm, and a second leg that includes the second end and that defines a hinge gap with the second leg of the first hinge member.

8. The contact arrangement of claim 7, characterized in that the movable main contact is positioned on the first side of the main contact arm, the first end of the arcing contact arm extends beyond the first end of the main contact arm, and the movable arcing contact is positioned on a second side of the arcing contact arm opposite the first side of the arcing contact arm.

9. The contact arrangement of claim 7, characterized in that the pivot means comprises spaced apart first and second pivot arms extending from the first end of the first hinge member for positioning the main contact arm and the arcing contact arm therebetween.

10. The contact arrangement of claim 9, wherein the pivot means further comprises a pin extending through the main contact arm between the pivot arms providing pivotable support for the main contact arm.

11. The circuit interrupter of claim 8, characterized in that the first bias spring is a first coil spring extending through a first hole in the arcing contact arm and between the support member and a second surface of the main contact arm proximate the arcing contact arm, the second bias spring is a second coil spring extending between the support member and the first surface of the arcing contact arm, and the connecting member is a pin slidably extending through the first hole and through a second hole in the main contact arm that is aligned with the first hole.

12. The contact arrangement of claim 5, wherein the hinge means is characterized in that:

the first hinge member is a resilient, substantially flat member that further comprises a first side supporting the first side of the main contact arm at the support position;

the main contact arm further includes an elbow defining an obtuse first included angle, extending from the support position to the second end of the main contact arm;

the second hinge member is a substantially flat member that further comprises a first side and a second side opposite the first side, each extending between the first and second ends, the first side defining a substantially wedge-shaped hinge member gap with the first side of first hinge member, and a hook including a first portion extending toward the main contact arm that includes the first end and that engages the elbow; and third bias means positioned between the first bias means and the support position spring biases the second ends of the main and arcing contact arms toward one another so as to engage the hook therebetween.

13. The contact arrangement of claim 12, further characterized in that the hook and the elbow define a wedge-shaped lever gap in the closed circuit position that decreases in size as the main contact arm moves to the open circuit position.

14. The contact arrangement of claim 13, wherein the hook further includes a second portion distal from the first end of the second hinge member, defining a second included angle with the first portion of the hook that is greater than 90°.

15. The contact arrangement of claim 13, wherein the first and second included angles are each about 120°.

16. The contact arrangement of claim 13, wherein the movable main contact is positioned on a lower side of the main contact arm, the first end of the arcing contact arm extends beyond the first end of the main contact arm, and the movable arcing contact is positioned on the lower side of the arcing contact arm.

17. The contact arrangement of claim 13, characterized in that the first bias spring is a first coil spring extending through a first hole in the arcing contact arm and between the support member and a second surface of the main contact arm proximate the arcing contact arm, the second bias spring is a second coil spring extending between the support member and the first side of the arcing contact arm, and the connecting member is a pin slidably extending through the first hole and through a second hole in the main contact arm that is aligned with the first hole.

18. A contact arrangement for a circuit breaker, including a fixed contact and a movable contact, first terminal means for operatively connecting the fixed contact to a first terminal of the breaker, an elongated, a movable contact arm carrying the movable contact near a first end, bias means biasing the movable contact into engagement with the fixed contact in a closed circuit position, and movable hinge means for operably connecting the contact arm to a second terminal of the breaker and for motivating the movable contact into an open circuit position in response to a high current condition, the hinge means comprising:

an elongated, conducting, first hinge member, including a first end supporting the contact arm at a support position spaced apart from a second end of the arm;

an elongated, conducting, second hinge member, comprising a first end spaced apart from the first end of the first hinge member and in electrical contact with the contact arm such that the second end of the contact arm is positioned between the hinge members;

fastening means for fixing a second end of each of the hinge members in close proximity to each other such that the first hinge member and the second hinge member provide spaced apart, parallel conduction paths in the closed circuit position; and bias means positioned between the first ends of the hinge members and the fastening means for spring biasing the first ends of the hinge members towards each other, wherein the high current condition generates an attractive electromagnetic force between the hinge members for exerting a levering force on the second end of the contact arm for motivating the movable contact into the open circuit position.

19. The contact arrangement of claim 18, wherein the hinge means is characterized in that:

the first hinge member is a fixed member further comprising pivot means near the first end for pivotally supporting the contact arm at the support position; and the second hinge member is a movable resilient member.

20. The contact arrangement of claim 19, wherein the first hinge member is an L-shaped member further comprising a first leg that includes the first end oriented about perpendicular to the contact arm in the closed circuit position, and a second leg that includes the second end oriented about parallel with the contact arm in the closed circuit position.

21. The contact arrangement of claim 20, characterized in that the second hinge member further comprises an angled first leg that includes the first end and that exerts a levering force on a portion of the contact arm overhanging the support position, and a second leg that includes the second end and that defines a hinge gap with the second leg of the first hinge member.

22. The contact arrangement of claim 20, characterized in that the pivot means comprises spaced apart first and second pivot arms extending from the first end of the first hinge member for positioning the contact arm therebetween.

23. The contact arrangement of claim 22, wherein the pivot means further comprises a pin extending through the main contact arm between the pivot arms providing pivotable support for the contact arm.

24. The contact arrangement of claim 18, wherein the hinge means is characterized in that:

the first hinge member is a resilient, substantially flat member that further comprises a side supporting the main contact arm at the support position;

the contact arm further includes an elbow defining an obtuse first included angle, extending from the support position to the second end of the main contact arm; and the second hinge member is a substantially flat member that further comprises a side defining a substantially wedge-shaped hinge member gap with the side of the first hinge member and a hook including a first portion extending toward the contact arm that includes the first end and that engages the elbow.

25. The contact arrangement of claim 24, further characterized in that the hook and the elbow define a wedge-shaped lever gap in the closed circuit position that decreases in size as the contact arm moves to the open circuit position.

26. The contact arrangement of claim 25, wherein the hook further includes a second portion distal from the first end of the second hinge member, defining with the first portion of the hook a second included angle that is greater than 90°.

27. The contact arrangement of claim 26, wherein the first and second included angles are each about 120°.

28. A contact arrangement for a circuit breaker, including a fixed main contact located nearby a fixed arcing contact, first terminal means for operatively connecting the fixed main and fixed arcing contacts to a first terminal of the breaker, a movable contact assembly movable between a closed circuit position and an open circuit position with the fixed main and arcing contacts, second terminal means for operably connecting the movable contact assembly to a second terminal of the breaker, wherein the movable contact assembly comprises:

an elongated, substantially flat, conducting, main contact arm, including first and second sides extending between first and second ends and a movable main contact on the first side near the first end;

an elongated, substantially flat, conducting arcing contact arm angularly spaced from the main contact arm in the closed circuit position and distal from the fixed main contact in a common plane of movement of the main contact arm and the arcing contact arm, including first and second sides extending between first and second ends and a movable arcing contact on the first side near the first end, wherein the second side of the main contact arm faces the first side of the arcing contact arm and supports the arcing contact arm near the second end of the arcing contact arm, wherein the first end of the arcing contact arm including the movable arcing contact overhangs the first end of the main contact arm, and the second end of the arcing contact arm overhangs the second end of the main contact arm;

a fixed, L-shaped, conducting first hinge member, including a first end on a first leg that is about perpendicular to the main contact arm in the closed circuit position, a second end operably connected to the second terminal on a second leg that is about parallel to the main contact arm in the closed circuit position, and pivot means at the first end pivotally supporting the main contact arm at a support position spaced apart from the second end of the main contact arm;

an elongated, conducting, second hinge member defining a hinge member gap with the first hinge member, including a first end supported by the arcing contact arm and a second end operably connected to the second terminal such that the first and second hinge members provide parallel conduction paths;

fastening means for fastening the second ends of the hinge members together;

hinge bias means for spring biasing the first and second hinge members towards each other;

contact arm bias means located between the movable main contact and the support position, including:

a link member located between the support position and the movable main contact and by which the arms are mechanically positioned between the closed circuit and open circuit positions, comprising a support member spaced apart from the second side of the arcing contact arm, a retention member spaced apart from the first side of the main contact arm in the closed circuit position, and a connecting pin connecting the support member and the retention member and extending through a first hole in the arcing contact arm and a second hole in the main contact arm aligned with the first hole;

a first compression spring extending through the first hole between the support member and the second side of the main contact arm for spring biasing the movable main contact into engagement with the fixed main contact in the closed circuit position; and a second compression spring extending between the support member and the second side of the arcing contact arm for spring biasing the movable arcing contact into engagement with the fixed arcing contact in the closed circuit position such that the main contact arm and the arcing contact arm provide spaced apart, parallel conduction paths in the closed circuit position, wherein a high current condition generates a first attractive electromagnetic force therebetween for moving the first end of the main contact arm in the plane of movement so as to disengage the movable main contact from the fixed main contact before the movable arcing contact disengages from the fixed arcing contact, and the high current condition generates a second attractive electromagnetic force between the hinge members for exerting a levering force on the arcing contact arm for moving the movable arcing contact in the plane of motion away from the fixed arcing contact and the movable main contact in the plane of motion away from the fixed main contact into the open circuit position.

29. The circuit interrupter of claim 28, characterized in that the fixed main contact and the fixed arcing contact are connected to the first terminal by a U-shaped magnetic repulsion member located below the main contact arm, comprising a first end connected to the fixed main contact and the fixed arcing contact, an upper leg extending therefrom about in parallel with the main contact arm to a position below the second end of the main contact arm, and a lower leg extending therefrom below the upper leg to a second end operatively connected to the first terminal.

30. A contact arrangement for a circuit breaker, including a fixed main contact located nearby a fixed arcing contact, first terminal means for operatively connecting the fixed main and fixed arcing contacts to a first terminal of the breaker, a movable contact assembly movable between a closed circuit position and an open circuit position with the fixed main and arcing contacts, second terminal means for operably connecting the movable contact assembly to a second terminal of the breaker, wherein the movable contact assembly comprises:

an elongated, substantially flat, conducting main contact arm, a movable main contact on a first side near a first end engaging the fixed main contact in the closed circuit position, and an elbow defining an obtuse first included angle on the second side, the elbow including the second end;

an elongated, substantially flat, conducting first hinge member supporting an outer corner of the elbow at a support position near a first end of the first hinge member, wherein the first hinge member and the main contact arm are oriented substantially in line in the closed circuit position;

an elongated, substantially flat, conducting second hinge member defining a substantially wedge-shaped hinge member gap with the first hinge member, including a hook at a first end that engages the elbow, the hook characterized by a first portion extending toward the main contact arm;

fastening means for fixing a second end of each of the hinge members to each other and to the second terminal means such that the hinge members provide parallel conduction paths;

an elongated, substantially flat, conducting arcing contact arm angularly spaced from the main contact arm in the closed circuit position and distal from the fixed main contact in a common plane of movement of the main contact arm and the arcing contact arm, including a movable arcing contact positioned on a first side of the arcing contact arm near a first end of the arcing contact arm overhanging the first end of the main contact arm, an angled portion including a second end angled away from the main contact arm and supported by the hook, the first side defining a contact arm gap with the main contact arm such that the main contact arm and the arcing contact arm provide spaced apart, parallel conduction paths in the closed circuit position;

hinge bias means positioned between the first ends of the hinge members and the fastening means for spring biasing the first ends of the hinge members towards each other, wherein the high current condition generates a first attractive electromagnetic force between the hinge members for exerting a levering force on the elbow for motivating the movable main contact into the open circuit position;

first contact arm bias means located between the movable main contact and the support position for spring biasing the movable main contact into engagement with the fixed main contact in the closed circuit position and for spring biasing the movable arcing contact into engagement with the fixed arcing contact in the closed circuit position such that the main contact arm and the arcing contact arm provide spaced apart, parallel conduction paths in the closed circuit position, including:

a link member by which the arms are mechanically positioned between the closed circuit and open circuit positions, comprising a support member spaced apart from a second side of the arcing contact arm that is spaced apart from the first side, a retention member proximate the main contact arm distal from the arcing contact arm, and a connecting member connecting the support member and the retontact a first bias spring biasing the main contact arm away from the support member; and a second bias spring biasing the arcing contact arm away from the support member, wherein the retention member is spaced apart from the main contact arm in the closed circuit position; and second contact arm bias means located between the first contact arm bias means and the support position for spring biasing the angled portion of the arcing contact arm towards the elbow so as to clasp the hook therebetween, wherein a high current condition generates a first attractive electromagnetic force between the contact arms for moving the first end of the main contact arm in the plane of movement so as to disengage the movable main contact from the fixed main contact before the movable arcing contact disengages from the fixed arcing contact, and wherein the high current condition generates a second attractive electromagnetic force between the hinge members for exerting a levering force on the elbow for moving the main contact arm in the plane of movement so as to disengage the movable main contact from the fixed main contact.

31. The contact arrangement of claim 30, characterized in that the fixed main contact and the fixed arcing contact are operatively connected to the first terminal by a U-shaped magnetic repulsion member that includes a first end connecting to the fixed main contact and the fixed arcing contact, a first leg proximate the main contact arm extending from the first end about in parallel with the main contact arm in the closed circuit position to a position near the support position, and a second leg distal from the main contact arm extending therefrom to a second end operatively connected to the first terminal.

32. The contact arrangement of claim 5, wherein the hinge means is characterized in that:

the first hinge member is a fixed member further comprising pivot means at the first end for pivotally supporting the main contact arm;

the lever portion of the main contact arm supports a portion of the arcing contact arm overhanging the support position;

the first side of the arcing contact arm near the second end of the arcing contact arm supports the second hinge member;

the second hinge member is a resilient member; and the high current condition generates an attractive electromagnetic force between the hinge members for exerting a levering force on the arcing contact arm for moving the movable arcing contact in the plane of motion away from the fixed arcing contact.

33. A contact arrangement for a circuit breaker, including a fixed main contact interconnected with a first terminal means, a movable contact assembly movable between a closed position and an open position interconnected with a second terminal means, said movable contact assembly comprising:

a conducting main contact arm including a movable main contact;

pivot means for pivoting said main contact arm thereon;

a portion of said main contact arm extending away from said pivot means;

said pivot means bring disposed between said main contact and said latter portion;

a first conductor means disposed in said circuit breaker with one portion thereof in a disposition of electrical conduction with said main contact arm and another portion thereof in a disposition of electrical conduction with said second terminal means;

a second conductor means a portion of which is biasedly spaced from said first conductor means in a common plane of movement of said first conductor means and said second conductor means by a predetermined bias force for causing relative attractive motion between said first conductor means and said second conductor means in said common plane of movement when electrical current flows in each in substantially parallel paths and in substantially the same direction to generate an attractive magnetic force sufficient to overcome said bias force, said second conductor means having a portion thereof in a disposition of electrical conduction with said main contact arm and a portion thereof in a disposition of electrical conduction with said second terminal means for providing one of said parallel paths, said second conductor means having a portion thereof in a disposition of mechanical interconnection with said portion of said main contact arm, said attractive motion causing said second conductor means to mechanical interact with said portion of said main contact arm to cause said main contact arm to pivot to cause relative separation between said movable main contact and said fixed main contact.

* * * * *